US007218575B2

(12) United States Patent
Rosevear

(10) Patent No.: US 7,218,575 B2
(45) Date of Patent: May 15, 2007

(54) ANGULAR TWILIGHT CLOCK

(76) Inventor: John M. Rosevear, 10580 Highland Rd., White Lake, MI (US) 48386

( * ) Notice: Subject to any disclaimer, the term of this patent is extended or adjusted under 35 U.S.C. 154(b) by 318 days.

(21) Appl. No.: 10/698,758

(22) Filed: Oct. 31, 2003

(65) Prior Publication Data

US 2005/0094492 A1 May 5, 2005

(51) Int. Cl.
*G04B 19/22* (2006.01)

(52) U.S. Cl. ..... 368/21; 368/23; 368/223

(58) Field of Classification Search ..... 368/15, 368/17, 82, 84, 223, 228, 239, 242, 21, 23
See application file for complete search history.

(56) References Cited

U.S. PATENT DOCUMENTS

| | | | | |
|---|---|---|---|---|
| 536,504 | A | 3/1895 | Arriaga | |
| 557,173 | A | 3/1896 | Thompson | |
| 1,832,342 | A | 11/1931 | Willis | |
| 2,227,995 | A | 1/1941 | Bacon | |
| 2,299,913 | A | 10/1942 | Clough | |
| 3,012,716 | A | 12/1961 | Gross | |
| 4,274,151 | A | 6/1981 | Kamiwaki | |
| 4,464,058 | A | 8/1984 | Weller | |
| 4,551,027 | A * | 11/1985 | Spruck | 368/15 |
| 4,669,891 | A * | 6/1987 | Rosevear | 368/21 |
| 4,759,002 | A * | 7/1988 | Cash | 368/15 |
| 4,893,291 | A | 1/1990 | Bick et al. | |
| 5,044,961 | A | 9/1991 | Bruskewitz | |
| 5,146,436 | A | 9/1992 | Wright | |
| D351,355 | S | 10/1994 | Kaneko | |
| D357,871 | S | 5/1995 | Biancardi | |
| D362,644 | S | 9/1995 | Chen | |
| 5,490,122 | A | 2/1996 | Kojima | |
| 5,572,489 | A | 11/1996 | Born et al. | |
| 5,631,878 | A * | 5/1997 | Chen | 368/21 |
| 5,694,376 | A | 12/1997 | Sullivan | |
| D392,578 | S | 3/1998 | Farsai | |
| D392,580 | S | 3/1998 | Farsai | |
| 5,845,257 | A | 12/1998 | Fu et al. | |
| 5,898,645 | A | 4/1999 | Sugiyama | |
| 5,907,523 | A * | 5/1999 | Richins | 368/21 |
| 5,917,778 | A | 6/1999 | James et al. | |
| 5,982,710 | A | 11/1999 | Rawat et al. | |
| 6,144,619 | A | 11/2000 | Reisman | |
| 6,198,698 | B1 * | 3/2001 | Graves | 368/82 |
| 6,219,307 | B1 | 4/2001 | Chitturi | |
| 6,233,204 | B1 | 5/2001 | Chu et al. | |
| 6,249,486 | B1 | 6/2001 | Chitturi | |

(Continued)

OTHER PUBLICATIONS

General Marketing Report Developed for "The Zone Watch" By Raymon Lopez.

(Continued)

*Primary Examiner*—Ren Yan
(74) *Attorney, Agent, or Firm*—Howard & Howard Attorneys, P.C.

(57) ABSTRACT

A method and apparatus for displaying time, the day sequence for the beginning and ending of twilight, sunrise and sunset in pie-shaped section on a circular clock face. A corresponding day sequence is retrieved from a memory and presented on a circular clock face in pie-shaped sections that represent twilight, day and night for a particular coordinate position and calendar date.

23 Claims, 4 Drawing Sheets

U.S. PATENT DOCUMENTS

| | | | | |
|---|---|---|---|---|
| 6,275,449 | B1 | 8/2001 | Wang | |
| 6,310,547 | B1 * | 10/2001 | Parker | 340/540 |
| 6,359,839 | B1 * | 3/2002 | Schenk et al. | 368/16 |
| 6,449,219 | B1 * | 9/2002 | Hepp et al. | 368/16 |
| 6,901,032 | B1 * | 5/2005 | Eo et al. | 368/15 |

OTHER PUBLICATIONS

Master Clocks & Secondaries by American Time & Signal Co. pp. 90-91.

* cited by examiner

ANGULAR TWILIGHT CLOCK

BACKGROUND OF THE INVENTION

1. Field of the Invention

The subject invention relates to a method for displaying time. More specifically, the subject invention relates to a method for displaying time at a particular coordinate position on the earth.

2. Description of the Prior Art

It is often desirable to know the commencement of light, darkness and the twilight. This need is often complicated when travelling between time zones. Prior clock systems provide clocks that indicate times for sunrise, sunset and twilight. One such clock system is described in the U.S. Pat. No. 4,669,891 to the inventor herein, Rosevear. The prior Rosevear '891 patent discloses a keyboard for inputting an area code or an airport designation for a geographical location. A memory contains information of the sunrise, the sunset time and the twilight duration for each area code or airport designation that can be selected. A microprocessor generates a signal, based on information gathered from the memory, which corresponds to either the input area code or the input airport designation. The signal is then presented on a video display screen in parallel vertical sections that represent juxtaposed hours of the day for the selected geographical location that includes each of the day, night and twilight hours.

Another clock system is described in the U.S. Pat. No. 6,449,219 to Hepp et al. (the '219 patent). The '219 patent provides an analog clock that is contained within a time sensing information display device. The display device contains a rectangular display area. On the display area is a graphical depiction of a tree with a round treetop, a horizon and a sky. The analog clock is incorporated within the round treetop. As the time of day changes, the sky alters to show a sun or a moon that is either waxing or waning. Furthermore, the display device incorporates a global positioning receiver which allows the proper display of the time, the sun and the moon based on the display devices' geographical location.

Although the prior art clock systems provide a visual display of day, night and twilight hours or a visual display of the sun and moon based on a geographical location, derived from a global positioning system, there remains an opportunity for a visual clock system which provides a more instantly understandable method of displaying the day, night and twilight hours based on geographical coordinates and a calendar date.

SUMMARY OF THE INVENTION AND ADVANTAGES

The invention provides a method and apparatus for displaying time including storing a day sequence that includes times for the beginning and ending of twilight and sunrise and sunset for each calendar day of the year for various coordinate positions in a memory. A stored day sequence is retrieved from the memory that corresponds to a registered current coordinate position and current calendar day. The final step includes presenting the current time on a circular clock face with pie-shaped sections for twilight.

Accordingly, an improved visual display of pie-shaped twilight hours, based on a coordinate position and calendar date, is established.

BRIEF DESCRIPTION OF THE DRAWINGS

Other advantages of the present invention will be readily appreciated as the same becomes better understood by reference to the following detailed description when considered in connection with the accompanying drawing wherein.

DETAILED DESCRIPTION OF THE PREFERRED EMBODIMENT

Figure 1:
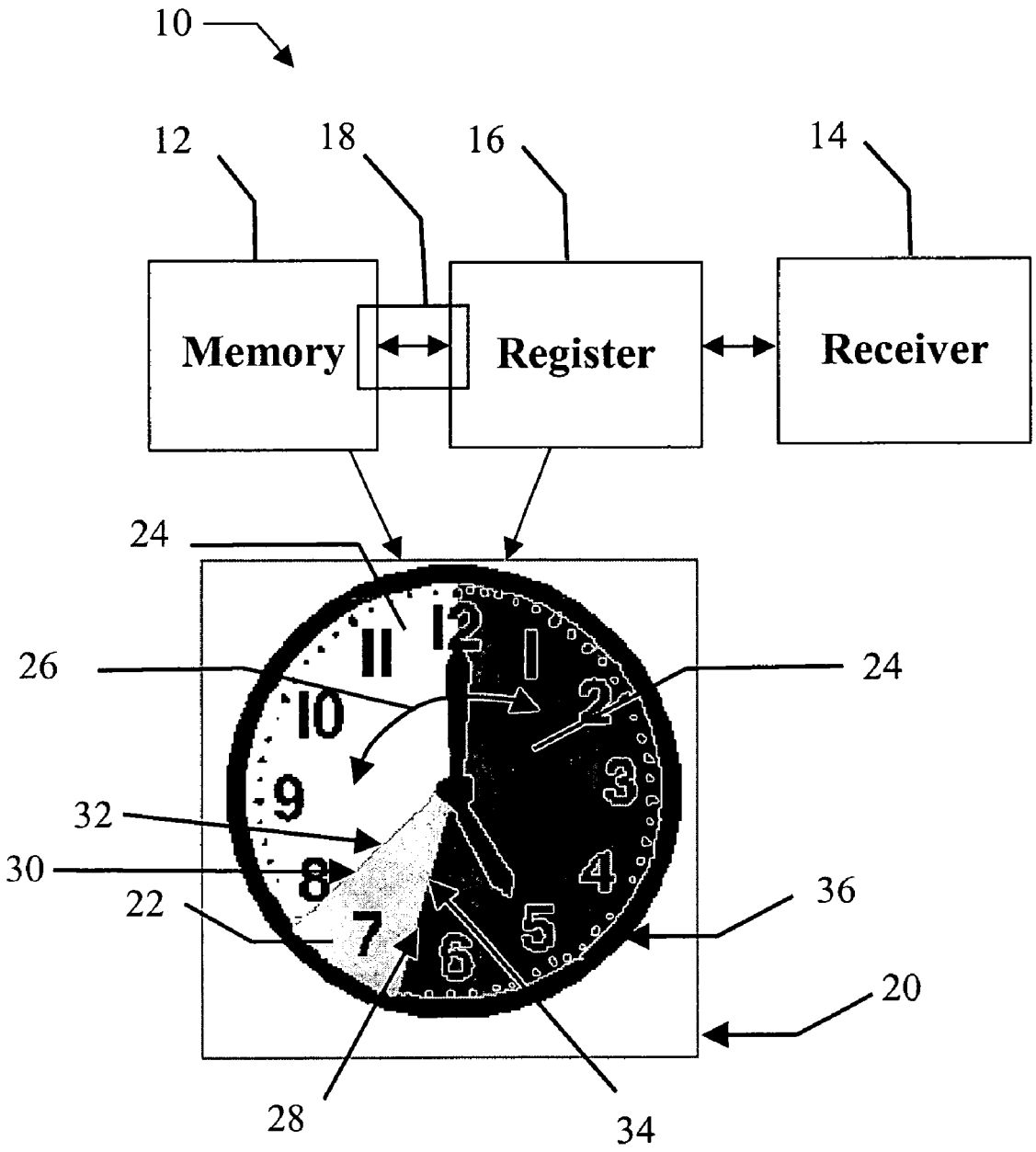
FIG. 1 is a diagram illustrating an apparatus for displaying time.
Figure 2:
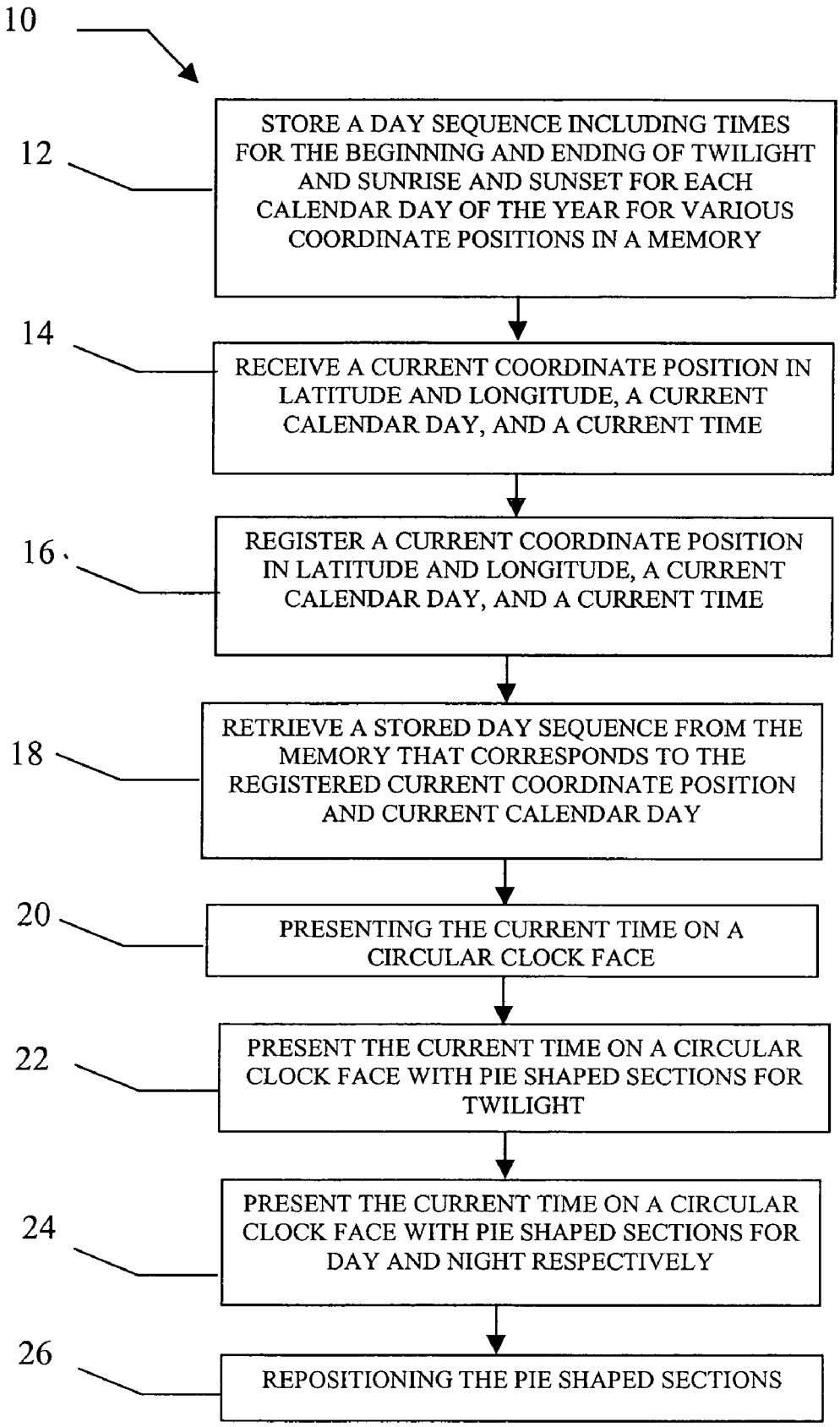
FIG. 2 is a block diagram illustrating a method for displaying time.

Referring to FIGS. 1 and 2, a method and apparatus for displaying time are generally shown at 10. Those skilled in the art will appreciate that the term "twilight conditions" used herein refers to the time for twilight, sunrise and sunset. Twilight is the soft, diffused light from the sky when the sun is ante meridian or post meridian below the horizon. Twilight occurs either from daybreak to sunrise or from sunset to darkness. There are three scientifically recognized types of twilight: civil, nautical and astronomical. Each is defined by how the distance or angle of the sun's center below the horizon. Civil twilight is when the sun's center is six degrees (6°) below the horizon; nautical twilight is when the sun's center is twelve degrees (12°) below the horizon; and astronomical twilight is when the sun's center is eighteen degrees (18°) below the horizon. Twilight conditions vary based on the geographical location and the calendar date. The method described herein displays time on an analog clock face 36 with pie-shaped sections for the twilight conditions 22. The analog clock face 36 is preferably circular and can be presented on a variety of electronic devices with a memory 12 and a register 16. These devices can be a personal data assistant (PDA), a personal computer, a desk clock, a wall clock, or even a wrist watch. However, those skilled in the art will realize that other devices can be utilized so long as they employ the necessary memory and registering capability.

A memory 12 stores a day sequence that includes times for the beginning and ending of twilight, sunrise and sunset for each calendar day of the year for various coordinate positions. A receiver 14 receives a current coordinate position in latitude and longitude, a current calendar day and a current time. A register 16 is operatively connected to the memory 12 and the receiver 14.

First, the receiver 14 receives a current coordinate position in latitude and longitude, a current calendar day and a current time. In the preferred embodiment, the receiver 14 is a global positioning receiver 14. The global positioning receiver 14 receives information pertaining to a current coordinate position in latitude and longitude, a corresponding current calendar day, and a current time by receiving a global positioning signal and determining the current calendar day, the current time, and the current coordinate position. Additional types of receivers 14 can also be a Long range navigation (LORAN) receiver, a radio, or a cell phone. However, the receiver 14 can also establish a location by being a manual input device 14. In this embodiment, registering a current coordinate position in latitude and longitude, a current date and a current time results from manually inputting the coordinate position in latitude and longitude, the current calendar date and the current time into the receiver 14. One skilled in the art can appreciate that inputting the information manually would be helpful when the user is curious about the twilight conditions for various geographical locations at varying dates and times. Alternatively, receiving this information can come from manually inputting the coordinate position in latitude and longitude and then receiving the corresponding calendar date and corresponding time from the atomic clock. In yet another embodiment, receiving this information comes from the user choosing a city, a calendar date and a time from a pull-down menu on the electronic device.

Next, the register 16 registers the current coordinate position in latitude and longitude, the current calendar day and the current time from the receiver 14. The register 16, takes this registered information and retrieves 18 a stored day sequence from the memory 12 that corresponds to the registered coordinate position and current calendar date and presents the current time on a display device 20. The stored day sequence is preferably calculated through a series of algorithms based on the current coordinate position, the current day and the current time. However, the stored day sequence can be based on discrete coordinated positions.

A display 20 is operatively connected to the register 16 and the memory 12. The display 20 presents the current time on a circular clock face 36 with pie-shaped sections for twilight 22.

The pie-shaped sections for twilight 22 have a first and a second boundary 28, 30 that define the duration of civil, nautical or astronomical twilight. The first and second boundary 28, 30 of the pie-shaped section for twilight 22, in the clockwise direction, depends on whether the previous section 24 corresponds to either night or day. If the previous section 24 corresponds to night, then the first boundary 28 represents the start of the twilight time and the second boundary 30 represents the sunrise time. If the previous section 24 corresponds to day, then the first boundary 28 represents the sunset time and the second boundary 30 represents the end of twilight. Furthermore, the time duration between the first 28 and second 30 boundaries represents the duration for twilight. Twilight time can be civil, nautical or astronomical. In the preferred embodiment, the twilight time presented represents nautical twilight. In an alternative embodiment, any, or all, of civil, nautical and astronomical twilight time can be presented in these pie-shaped sections for twilight 22 at one time.

Additionally, the display includes pie-shaped sections for day and night 22, 24 respectively. The first boundary 32 for the day pie-shaped section 24, in the clockwise direction, represents the sunrise time. The second boundary 34 for the day pie-shaped section 24 represents sunset. For the night pie-shaped section 24, the first boundary 32 represents the end of night time twilight. The second boundary 34 of the night pied shaped section 24 represents the beginning of the day time twilight. Therefore, the time duration between the first 32 and second 34 boundaries of either the day or the night pie-shaped sections 24 represents the duration for either day or night respectively.

Figure 3:
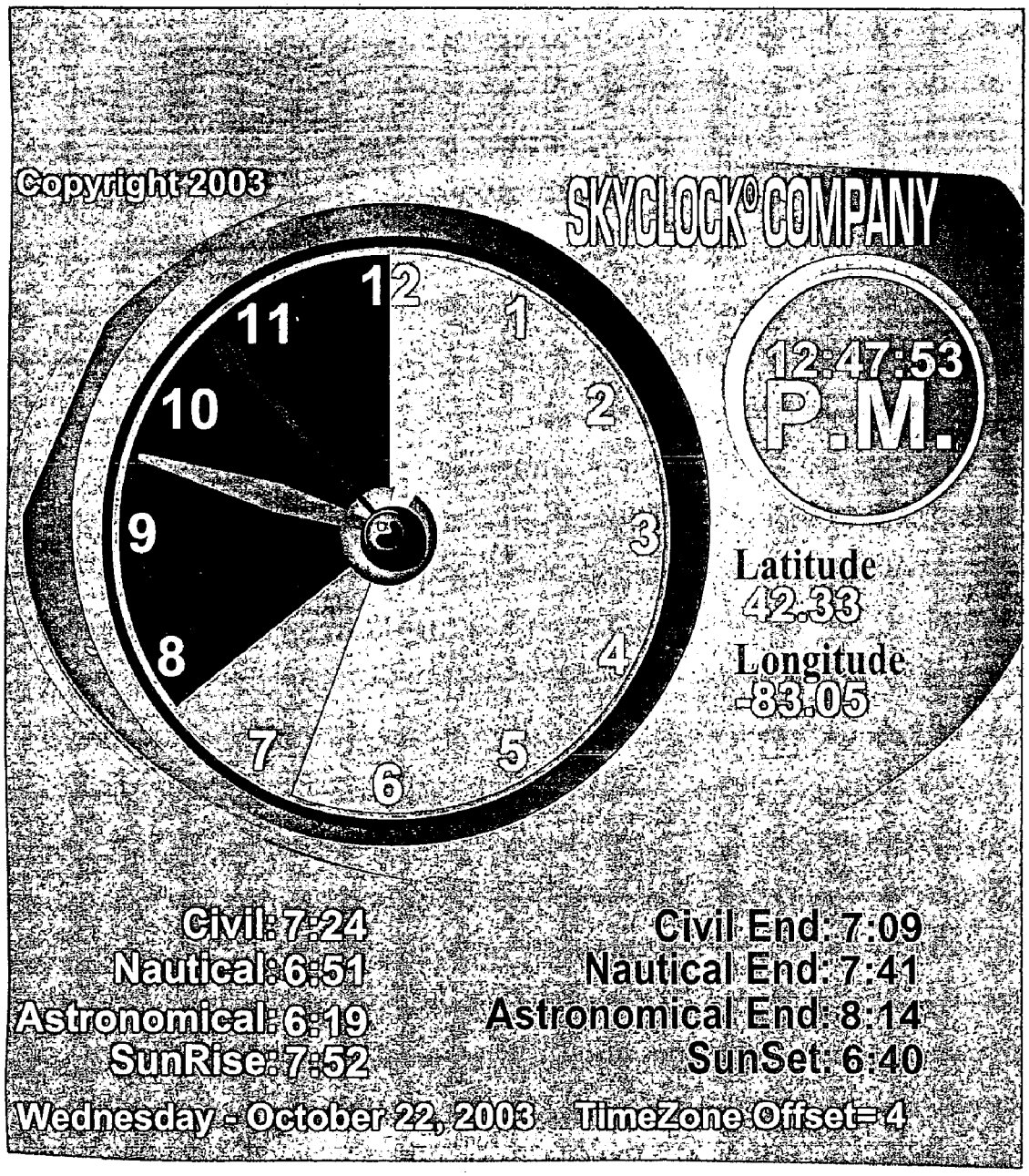
FIG. 3 is a example of the display of time generated by the method.
Figure 4:
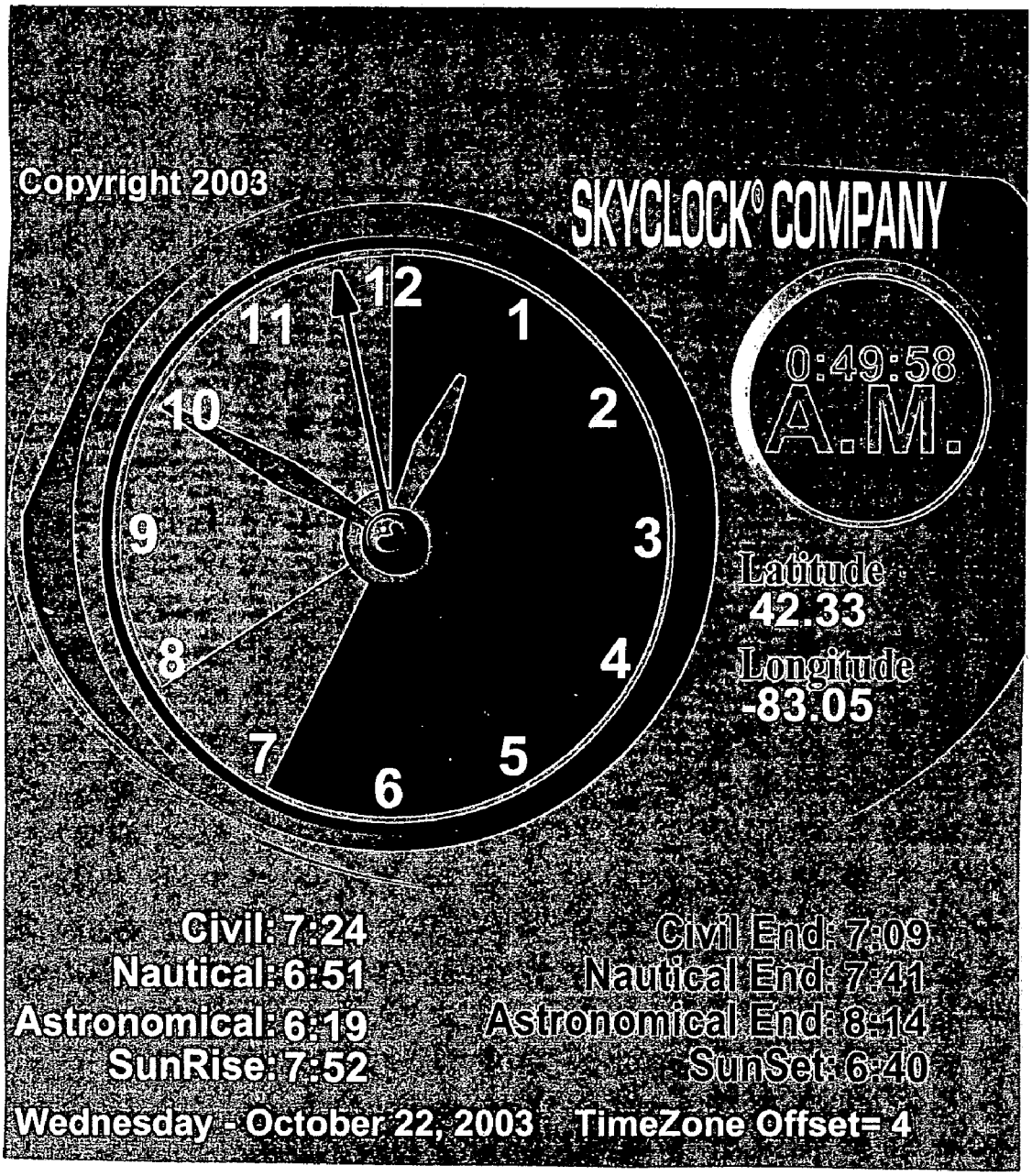
FIG. 4 is another example of the display of time generated by the method.

In the preferred embodiment, the time is presented on a twelve hour analog clock face 36. Examples of the preferred embodiment are shown in FIGS. 3 and 4. The pie-shaped sections for twilight 22 and either day or night 24, represent the twilight conditions for the successive twelve hours. The pie-shaped sections 22, 24 are differentiated by being different shades or colors. In the present invention, blue represents day, black represents night, and gray represents twilight. However, other colors can also be employed to satisfy individual preferences. As time progresses, the pie-shaped sections 22, 24 are repositioned at predetermined times 26 to reflect the successive twelve hours. Preferably, the predetermined times are noon and midnight respectively.

In an alternate embodiment, the time is presented on a twenty-four hour analog clock face 36. The pie-shaped sections for twilight, day and night 22, 24 represent the twilight conditions for the successive twenty four hours. As time progresses, the pie-shaped sections 22, 24 are repositioned 26 at a predetermined time to reflect the commencement of twilight, sunrise and sunset for the successive twenty-four hours. Preferably, the predetermined time for repositioning 26 the pie-shaped sections 22, 24 is midnight. In another embodiment, the pie-shaped sections 22, 24 are repositioned 26 continuously. Continuously can be every second, minute, hour or any arbitrary amount of time. With continuous repositioning 26 of the pie-shaped sections 22, 24, the clock face 36 represents the twilight conditions for the successive twelve hours, if using a twelve hour analog clock 36, or the successive twenty-four hours, if using a twenty-four hour analog clock 36. In yet another embodiment, the pie-shaped sections 22, 24 are repositioned 26 when the user manually requests an update to the display 20. This can be accomplished, for example, by pressing a button on the electronic device or by using a keyboard.

Those skilled in the art will appreciate additional times for repositioning 26 the pie-shaped sections 22, 24 may also be needed. For example, when the electronic device is moved to a new coordinate position, or if daylight saving time needs to be accounted for on the clock face 36. The device may automatically account for these by adjusting the time and repositioning 26 the pie-shaped sections 22, 24.

To provide the user with additional information, other embodiments of the invention can provide time and geographical information approximate the clock face 36. The information displayed can include the current calendar date, the current time zone, the current coordinate position in latitude and longitude, the current time digitally, and the times for twilight, sunrise and sunset.

Obviously, many modifications and variations of the present invention are possible in light of the above teachings.

What is claimed is:

1. A method for displaying time comprising:

storing a day sequence including times for the beginning and ending of twilight and sunrise and sunset for each calendar day of the year for various coordinate positions in a memory;

receiving a current coordinate position in latitude and longitude, a current calendar day, and a current time;

registering a current coordinate position in latitude and longitude, a current calendar day, and a current time;

retrieving a stored day sequence from the memory corresponding to the registered current coordinate position and current calendar day;

presenting the current time on a clock face;

displaying at least one twilight section on the clock face based on the stored day sequence for indicating the beginning and ending of twilight with the twilight section fixed on the clock face; and repositioning the twilight section on the clock face once the current time is after the ending of twilight.

2. A method for displaying time as set forth in claim 1 wherein the step of presenting the current time is further defined as displaying sections for day and night respectively with the sections for day and night fixed on the clock face.

3. A method for displaying time as set forth in claim 2 wherein the step of displaying the sections is further defined as presenting the sections for twilight and night and day corresponding to the successive twelve hours.

4. A method for displaying time as set forth in claim 2 wherein the step of displaying the sections is further defined as presenting the sections for twilight and night and day corresponding to the successive twenty-four hours.

5. A method for displaying time as set forth in claim 2 further including the step of repositioning at least one of the sections for day and night on the clock face once the current time is after the ending of twilight.

6. A method for displaying time as set forth in claim 1 wherein the step of repositioning the twilight section is further defined as repositioning the twilight section on the clock face at a predetermined time after the ending of twilight.

7. A method for displaying time as set forth in claim 6 wherein the step of presenting the current time on the clock face is further defined as presenting the current time on a twelve hour clock face.

8. A method for displaying time as set forth in claim 6 wherein the step of presenting the current time on the clock face is further defined as presenting the current time on a twenty-four hour clock face.

9. A method for displaying time as set forth in claim 6 wherein the step of repositioning the twilight section at the predetermined time is further defined as repositioning the twilight section at one of noon and midnight immediately following the ending of twilight.

10. A method for displaying time as set forth in claim 6 wherein the step of repositioning the twilight section at the predetermined time is further defined as repositioning the twilight section at midnight immediately following the ending of twilight.

11. A method for displaying time as set forth in claim 6 wherein the step of repositioning the twilight section on the clock face at a predetermined time is further defined as the step of repositioning the twilight section on the clock face before the next twilight.

12. A method for displaying time as set forth in claim 1 wherein the step of registering a current coordinate position in latitude and longitude, a current calendar day, and a current time is further defined as receiving a global positioning signal to determine the current calendar day, the current time, and the current coordinate position.

13. A method for displaying time as set forth in claim 12 further including the step of updating the time by receiving a global positioning signal at periodic intervals.

14. A method for displaying time as set forth in claim 1 wherein the step of registering a current coordinate position in latitude and longitude, a current calendar day and a current time is further defined as manually inputting the coordinate position in latitude and longitude, the current calendar day and the current time.

15. A method for displaying time as set forth in claim 1 wherein registering a current coordinate position in latitude and longitude, a current calendar day and a current time is further defined as manually inputting the coordinate position in latitude and longitude and receiving a corresponding calendar day and a corresponding time from an atomic clock.

16. A method for displaying time as set forth in claim 1 further including the step of displaying the current calendar day approximate the clock face.

17. A method for displaying time as set forth in claim 1 further including the step of displaying a current time zone approximate the clock face.

18. A method for displaying time as set forth in claim 1 further including the step of displaying the current coordinate position approximate the clock face.

19. A method for displaying time as set forth in claim 1 further including the step of displaying the time for the sunrise and sunset approximate the clock face.

20. A method for displaying time as set forth in claim 1 further including the step of displaying the time for twilight approximate the clock face.

21. A method for displaying time as set forth in claim 1 further including the step of displaying the time digitally approximate the clock face.

22. A method for displaying time as set forth in claim 1 wherein the step of displaying the at least one twilight section is further defined as displaying two twilight sections on the clock face based on the stored day sequence for indicating the beginning and ending of twilight for each twilight section with the twilight sections fixed on the clock face.

23. A method as set forth in claim 22 wherein the step of repositioning the twilight sections is further defined as repositioning the twilight sections on the clock face once the current time is after the ending of one of the twilight sections to present the next two consecutive twilight sections.

* * * * *